US005459014A

United States Patent [19]

Nishijima et al.

[11] Patent Number: 5,459,014

[45] Date of Patent: Oct. 17, 1995

[54] METHOD FOR FORMING A PHOTOGRAPHIC COLOR IMAGE WITH A PHOTOGRAPHIC MATERIAL CONTAINING A HYDROXY-PHENYL DERIVATIVE, USING A CHLORIDE-CONTAINING COLOR DEVELOPER

[75] Inventors: Toyoki Nishijima; Motoi Nishimura, both of Odawara, Japan

[73] Assignee: Konica Corporation, Japan

[21] Appl. No.: 302,115

[22] Filed: Sep. 7, 1994

Related U.S. Application Data

[63] Continuation of Ser. No. 97,711, Jul. 27, 1993, abandoned.

[30] Foreign Application Priority Data

Sep. 1, 1992 [JP] Japan ..... 4-4233815
Sep. 24, 1992 [JP] Japan ..... 4-4254947

[51] Int. Cl.[6] ..... G03C 7/392; G03C 7/42

[52] U.S. Cl. ..... 430/393; 430/372; 430/442; 430/435; 430/484; 430/485; 430/490; 430/551; 430/607; 430/963

[58] Field of Search ..... 430/963, 372, 430/607, 591, 435, 442, 484, 485, 490

[56] References Cited

U.S. PATENT DOCUMENTS

| | | | |
|---|---|---|---|
| 4,228,235 | 10/1980 | Okonogi et al. | 430/551 |
| 4,906,559 | 3/1990 | Nishigima et al. | 430/551 |
| 5,084,375 | 1/1992 | Umemoro et al. | 430/551 |
| 5,176,987 | 1/1993 | Nakamura et al. | 430/376 |
| 5,178,991 | 1/1993 | Morigaki et al. | 430/372 |

FOREIGN PATENT DOCUMENTS

| | | | |
|---|---|---|---|
| 393718 | 10/1990 | European Pat. Off. . | |
| 410450 | 1/1991 | European Pat. Off. . | |
| 520412 | 12/1992 | European Pat. Off. . | |
| 54-154325 | 12/1979 | Japan | 430/551 |

*Primary Examiner*—Richard L. Schilling
*Assistant Examiner*—J. Pasterczyk
*Attorney, Agent, or Firm*—Jordan B. Bierman; Bierman and Muserlian

[57] ABSTRACT

A method for forming a color photographic image is disclosed. The method comprises steps of imagewise exposing a silver halide color photographic light-sensitive material comprising a support, and a silver halide emulsion layer and a non-light-sensitive layer each provided on the support, developing the light-sensitive material with a color developer, and bleach-fixing the developed light-sensitive material with a bleach-fixing solution, wherein the silver halide emulsion layer or the non-light-sensitive layer contains a compound represented by the following Formula 1 and the color developer contains a chloride in an amount of not less than $6\times10^{-2}$ moles per liter;

Formula 1 wherein $R_1$ is a tertiary alkyl group; $R_2$ is a primary or a secondary alkyl group; $R_3$, $R_4$ and $R_5$ are each an alkyl group, an alkoxycarbonyl group, a phenoxycarbonyl group, an alkoxy group, a phenoxy group or a phenylthio group, the groups represented by $R_1$, $R_3$, $R_4$ or $R_5$ each may have a substituent and the group represented by $R_2$ may has a substituent other than a phenyl group.

8 Claims, No Drawings

METHOD FOR FORMING A PHOTOGRAPHIC COLOR IMAGE WITH A PHOTOGRAPHIC MATERIAL CONTAINING A HYDROXY-PHENYL DERIVATIVE, USING A CHLORIDE-CONTAINING COLOR DEVELOPER

This application is a continuation of application Ser. No. 08/097,711, filed Jul. 27, 1993, now abandoned.

FIELD OF THE INVENTION

This invention relates to a processing method for a silver halide photographic light sensitive material excellent in image preservability and antisweating property, as well as excellent in color developability and white background property each obtained in running treatments carried out in a rapid processing.

BACKGROUND OF THE INVENTION

In silver halide photographic light sensitive materials to be used for direct appreciation purposes such as color print papers, yellow, magenta and cyan couplers are commonly used in combination as the color forming agents for forming the color dye images.

The important factors for selecting these couplers include the color developability, image preservability and so forth of the resulting dye images. In particular, there have been increasing demands for improving the dye image preservability.

About the methods for improving the preservability of dye images, Japanese Patent Publication Open to Public Inspection (hereinafter referred to as JP OPI Publication) No. 62 -180367/1987, U.S. Pat. No. 4,906,559 and so forth described methods in which phenol derivatives having specific structures are used.

In the photographic field, on the other hand, there have been demands for silver halide photographic light sensitive materials capable of performing under rapid processing, conditions which provide high image quality and constantly stable characteristics.

Usually, silver halide photographic light sensitive materials are continuously processed through an automatic processor installed at individual photofinishing laboratories. As a part of the customer services to be improved, it has been required to develop and return the finished articles to the customers within the very day the customer's order is received and, recently, it has further been required to return the finished article to the customers within several hours from the receipt of the customer's order, so that the necessity for rapid processing services has been further increased. In addition to the above, the importance of rapid processing is increased from the viewpoint of the cost reduction, because production efficiency can be improved by shortening the processing time.

In rapid processing, however, color developability is liable to deteriorate when the aforementioned phenol type anti-discoloring agent, for example, is added. Therefore, any sufficient amount thereof cannot be added. Among these agents, there are some compounds capable of maintaining color developability without deterioration. However, when these compounds are used, they cause poor light fastness, background whiteness deteriorates and sweating is produced in running processing with the passage of time during rapid processing. Therefore, it is not so easy to satisfy all of the color developability, white background property, image preservability and anti-perspiration properties and new techniques have been strongly demanded.

SUMMARY OF THE INVENTION

It is, therefore, an object of the invention to provide a method for processing a silver halide photographic light sensitive material excellent in color developability and white background property even when carrying out a running treatment with the passage of time in a rapid processing, and improved on a printed image preservability and an anti-sweating property.

These and other objects of the invention will become apparent from the following detailed description.

It was discovered that the above-mentioned objects of the invention can be achieved as follows and, accordingly, this invention was invented.

The above object of the invention is accomplished by a method for forming a photographic color image comprising the steps of imagewise exposing a silver halide color photographic light-sensitive material comprising a support, and a silver halide emulsion layer and a non-light-sensitive layer each provided on the support, developing the light-sensitive material with a color developer, and bleach-fixing the developed light-sensitive material with a bleach-fixing solution, wherein the silver halide emulsion layer or the non-light-sensitive layer contains a compound represented by the following Formula 1 and the color developer contains a chloride in an amount of not less than $6\times10^{-2}$ moles per liter;

Formula 1

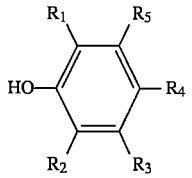

wherein $R_1$ is a tertiary alkyl group; $R_2$ is a primary or a secondary alkyl group; $R_3$, $R_4$ and $R_5$ are each an alkyl group, an alkoxycarbonyl group, a phenoxycarbonyl group, an alkoxy group, a phenoxy group or a phenylthio group, the groups represented by $R_1$, $R_3$, $R_4$ or $R_5$ each may have a substituent and the group represented by $R_2$ may has a substituent other than a phenyl group.

DETAILED DESCRIPTION OF THE INVENTION

In the above-given Formula 1 relating to the invention, $R_1$ represents a tertiary alkyl group, such as a t-butyl group, a t-pentyl group and a t-octyl group and, preferably, a t-butyl group; $R_2$ represents a primary or secondary alkyl group, such as a methyl group, an ethyl group and an isopropyl group and, preferably, a methyl group, provided, $R_2$ may be substituted by a substituent, but shall not be substituted by any phenyl group; and $R_3$, $R_4$ and $R_5$ represent each a hydrogen atom an alkyl group, such as a methyl group, an ethyl group, a butyl group and a dodecyl group, an alkoxycarbonyl group, such as an ethoxycarbonyl group, a phenoxycarbonyl group, such as a 2,4-di-t-butylphenoxycarbonyl group, an alkoxy group, such as a 2-ethylhexyloxy group, a phenoxy group, such as a 4-(2-ethylhexyl)phenoxy group and a 4-dodecyl-phenoxy group, a phenylthio group, such as a 3-t-butyl-4-hydroxy-5-methylphenylthio group.

The groups represented by the above-given $R_1$ through $R_5$ may be each substituted by a substituent. The groups represented by $R_4$ are each preferably an alkyl group.

Furthermore, it is preferable that the group represented by $R_4$ has the following group as a substituent;

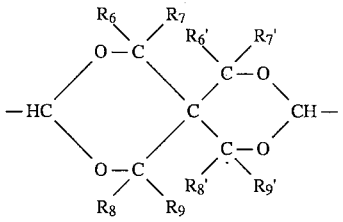

wherein $R_6$, $R_6'$, $R_7$, $R_7'$, $R_8$, $R_8'$, $R_9$ and $R_9'$ are each a hydrogen atom, an alkyl group or a phenyl group.

Among the compounds of Formula 1 which have the above group, those represented by the following Formula 1a or 1b are particularly preferable and those represented by Formula 1b are most preferable.

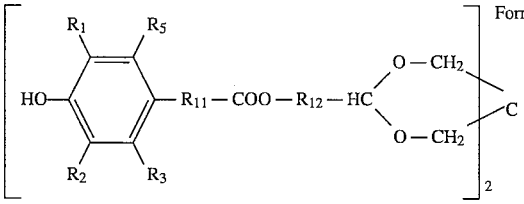

Formula 1a

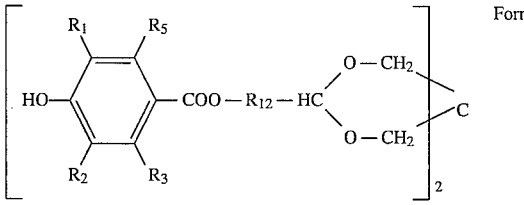

Formula 1b

In the above, $R_1$, $R_2$, $R_3$ and $R_5$ are each the same as $R_1$, $R_2$, $R_3$ and $R_5$ defined in Formula 1; and $R_{11}$ and $R_{12}$ are each an alkylene group such as ethylene group and isobutylene group.

The compounds represented by Formula 1 may also be used together with other anti-discoloring agents in combination.

The compounds represented by Formula 1 may also be added to any one of the light sensitive layers and non-light sensitive layers of light-sensitive material and, they are preferably added to at least one of the light-sensitive layers. As a light-sensitive layer, in which the compound of Formula 1 to be added, a blue-sensitive layer or red-sensitive layer is preferable and the blue-sensitive layer is more preferable. Adding amount of the compound of Formula 1 is preferably 0.01 g to 30 g, more preferably 0.05 to 0.2 g, per square meter of the light-sensitive material.

Now, the typical examples of the compounds represented by Formula 1 will be given below.

1-1

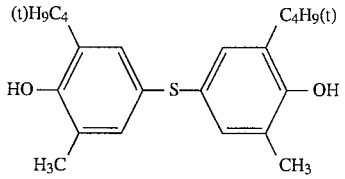

1-2

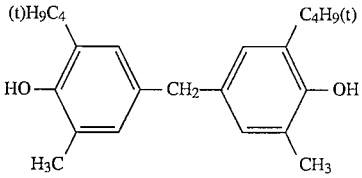

1-3

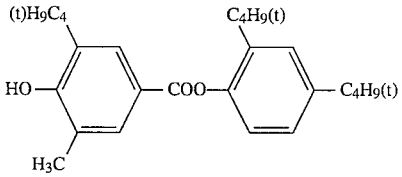

1-4

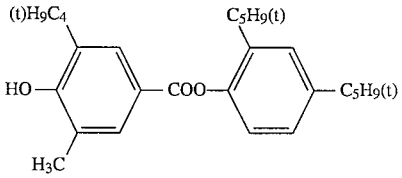

1-5

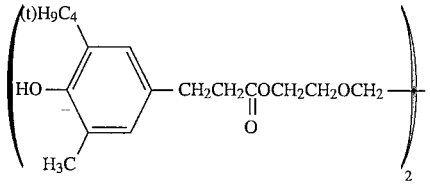

1-6

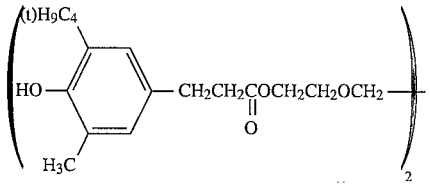

1-7

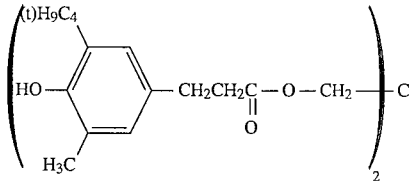

-continued
1-8
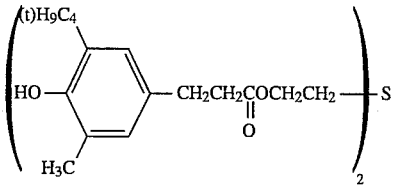
1-9
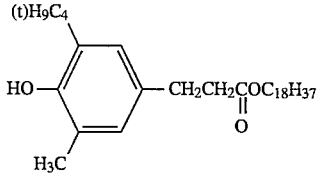
1-10
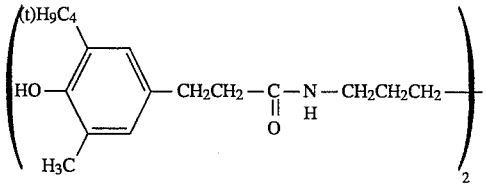
1-11
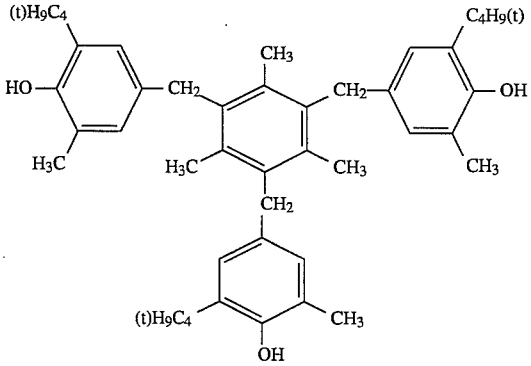
1-12
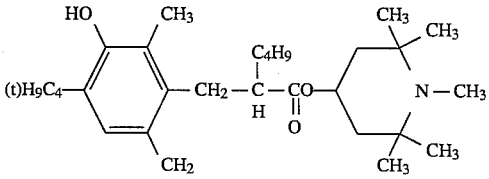
1-13
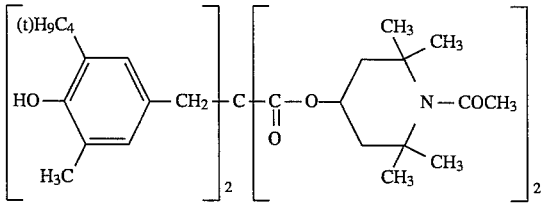
-continued
1-14
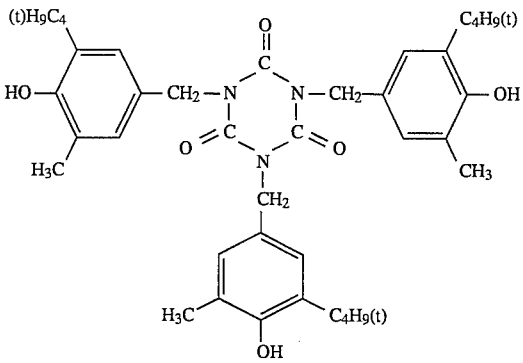
1-15
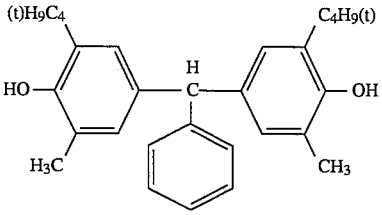
1-16
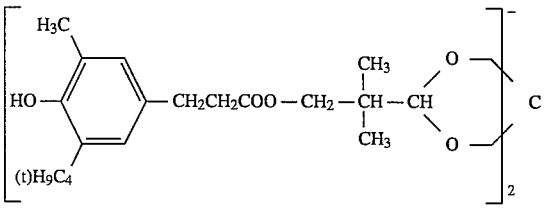
1-17
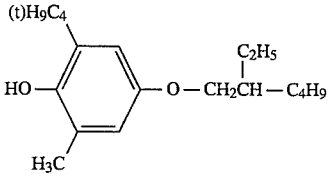
1-18
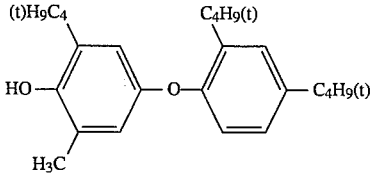
1-19
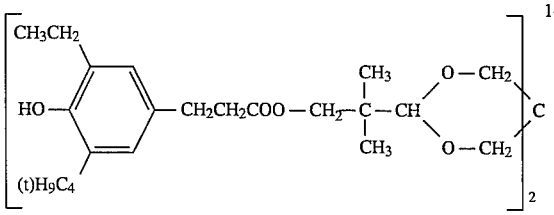
1-20
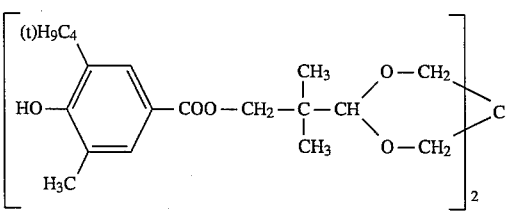

-continued 1-21

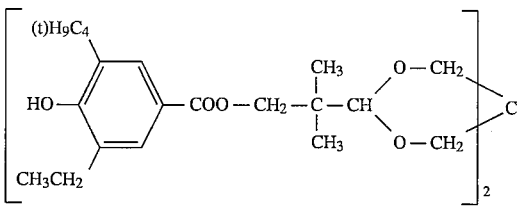

To the silver halide photographic light sensitive materials relating to the invention, any dyes having an absorption to various wavelength regions may be used for the anti-irradiation and anti-halation purposes.

As for the couplers applicable to the silver halide photographic light sensitive materials relating to the invention, any compounds capable of producing a coupling product having the spectral absorption maximum wavelength in a region having a wavelength longer than 340 nm, upon making a coupling reaction with the oxidized products of a color developing agent. The typical examples thereof include, particularly, those having been known as a yellow coupler having the spectral absorption maximum wavelength within the wavelength range of 350 to 500 nm, a magenta coupler having the spectral absorption maximum wavelength within the wavelength range of 500 to 600 nm and a cyan coupler having the spectral absorption maximum wavelength within the wavelength range of 600 to 750 nm.

As for the yellow couplers preferably applicable to the silver halide photographic light sensitive materials relating to the invention include, for example, those represented by Formula (Y-1) given in JP OPI Publication No. 4-114154/1992, p.8. The typical examples thereof include those having Formulas YC-1 through YC-9 given in the same JP Application, pp.9~11. Among them, YC-8 and YC-9 given in the same JP Application, p.11 are preferable, because they can reproduce yellow tones.

As for the magenta couplers preferably applicable to the silver halide photographic light sensitive materials relating to the invention include, for example, those represented by Formulas (M-I) and (M-II) each given in JP OPI Publication No. 4-114154/1992, p.12. The typical examples thereof include those having Formulas MC-1 through MC-11 given in the same JP Application, pp.13~16. Among them, MC-8 through MC-11 given in the same JP OPI Publication, pp.15~16 are preferable, because they are excellent in detailed expression as well as in color reproduction in blue, purple through red.

As for the cyan couplers preferably applicable to the silver halide photographic light sensitive materials relating to the invention include, for example, those represented by Formulas (C-I) and (C-II) each given in JP Application No. 2-234208/1990, p.17. The typical examples thereof include those having Formulas CC-1 through CC-9 given in the same JP Application, pp.18~21.

In the invention and when an oil-drop-in-water type emulsification-dispersion process is used for adding a coupler, the coupler is dissolved in a water-insoluble high-boiling organic solvent having a boiling point of not lower than 150° C. and, if required, a low-boiling and/or water-soluble organic solvent in combination, and the resulting solution is emulsified and dispersed in a hydrophilic binder such as an aqueous gelatin solution by making use of a surfactant. The dispersing means applicable thereto include, for example, a stirrer, a homogenizer, a colloid mill, a flow-jet mixer and a supersonic disperser. It is allowed to supplement a step for removing the low-boiling organic solvent either after completing the dispersion or at the same time when the dispersion is carried out. As for the high-boiling organic solvents applicable to dissolve and disperse the couplers, phthalic acid esters such as dioctyl phthalate and phosphoric acid esters such as tricresyl phosphate may preferably be used.

It is also allowed to replace the method in which a high-boiling organic solvent is used by the method in which couplers, a water-insoluble but organic solvent-soluble polymer compound and, if required, a low-boiling and/or water-soluble organic solvent are dissolved together, and the resulting solution is then emulsified and dispersed in a hydrophilic binder such as an aqueous gelatin solution with a surfactant by making use of one of various dispersing means. The water-insoluble but organic solvent-soluble polymers applicable thereto include, for example, a poly(N-t-butylacrylamide).

For the purpose of shifting the absorption wavelengths of a formed dye, it is allowed to use the compounds such as compound (d-11) given in JP OPI Publication No. 4-114154/1992, p.33 and compound (A'-1) given in the same JP Application, p.35. Besides the above, it is also allowed to use the fluorescent dye releasing compounds given in U.S. Pat. No. 4,774,187.

It is advantageous to use gelatin as the binder for the silver halide photographic light sensitive materials relating to the invention. If required, it is also allowed to use other gelatin, gelatin derivatives, graft polymers of gelatin and other macromolecules, proteins other than gelatin, sugar derivatives, cellulose derivatives and hydrophilic colloids including, for example, synthetic hydrophilic macromolecular substances such as those of a homopolymer or a copolymer.

A hardener may be applied to the binders for the silver halide photographic light sensitive materials relating to the invention.

The hardeners preferably applicable thereto include, for example, those of the vinylsulfone type or the chlorotriazine type. The vinylsulfone type hardeners preferably applicable thereto include, for example, the compounds given in JP OPI Publication No. 61-249054/1986, p.25, the 13th line in the right upper column to p.27, the 2nd line in the right upper column. Further, compound H-12 given in the same publication, p.26 is particularly preferable. As for the chlorotriazine type layer hardeners preferably applicable thereto include, for example, the compounds given in JP OPI Publication No. 61-245153/1986, p.3, the 1st line in the left lower column to p.3, the 4th line from the bottom of the right lower column, and p.3 the 4th line from the bottom of the right lower column to p.5, in the left lower column.

Further, the compounds denoted by XII-1 given in the same publication, p.4 are particularly preferable.

The above-mentioned hardeners are preferably used with a different kind of compounds in combination. These hardeners may also be added to any layers. These hardeners are preferably used in a proportion within the range of 0.1 to 10% by weight to the binder used.

In the invention, it is preferable to add an antimold to any one of layers. The antimolds preferably applicable thereto include, for example, the compounds represented by Formula II given in JP OPI Publication No. 3-157646/1991, p.9. The typical examples thereof include the exemplified compounds No.9 through No.22 given in the same application, pp. 69~70. Among them, the compound No.9 is particularly preferable.

As to silver halide composition of the grains of an emulsion relating to the invention, silver chloride grains or silver chlorobromide grains having a silver chloride content of not less than 90 mol % are preferable, which contain substantially no silver iodide. The term "contain substantially no silver iodide" means that silver iodide content of the grains is not more than 0.5 mol %, preferably 0.1 mol %, most preferably zero. The silver chloride content of the grains is preferably not less than 95 mol %. more preferably not less than 98 mol %, most preferably 99 mol % or more.

The silver halide grains relating to the invention may have any configurations. One of the preferable examples thereof is a cube having (100) faces as the crystal surfaces thereof.

As for the silver halide grains relating to the invention, the grains having a single configuration may be used, and the grains mixed up with various configurations may also be used.

There is no special limitation to the grain sizes of the silver halide grains relating to the invention. However, taking a rapid processability and other photographic characteristics such as photosensitivity into consideration, the grain sizes thereof are to be within the range of, preferably, 0.1 to 1.2 μm and, particularly, 0.2 to 1.0 μm.

In the silver halide grains of the invention, the grain size distribution thereof may be either of the polydisperse type or of the monodisperse type. They are preferable to be monodisperse type silver halide grains having a variation coefficient of, preferably, not more than 0.22 and, particularly, not more than 0.15. The variation coefficient is the value of $\sigma/\bar{r}$ wherein $\sigma$ is the standard deviation of the grain sized distribution and $\bar{r}$ is average grain size.

As for the apparatuses for preparing silver halide emulsions and processes for preparing the same, various apparatuses and processes well-known in the photographic field may be used.

The silver halide emulsions relating to the invention may be any ones prepared in an acidic process, a neutral process or an ammoniacal process. The resulting grains thereof may be grown up at the same time or may also be grown up after producing seed grains. The process for preparing the seed grains and the process for growing the seed grains may be the same with or different from each other.

As for the systems for reacting a soluble silver salt with a soluble halide, any one of the normal, reverse and double-jet precipitation processes and the combination thereof can be used. Among them, the double-jet precipitation process is preferably used. As one of the double-jet precipitation processes, the pAg controlled double-jet process described in, for example, JP OPI Publication No. 54-48521/1979 may also be used.

Besides the above, a silver halide solvent such as thioether may also be used, if required. It is also allowed that a compound having a mercapto group, a nitrogen-containing heterocyclic compound or a compound such as a sensitizing dye may be used by adding it when or after preparing silver halide grains.

The silver halide emulsions relating to the invention may be subjected to a sensitization process using a gold compound, a sensitization process using a chalcogen sensitizer or the combination thereof.

The chalcogen sensitizers applicable to the silver halide emulsions relating to the invention include, for example, a sulfur sensitizer, a selenium sensitizer and a tellurium sensitizer. Among them, the sulfur sensitizers are preferably used. The sulfur sensitizers include, for example, thiosulfate, allylthiocarbamidothiourea, allylisothiacyanate, cystine, p-toluenethiosulfonate, rhodanine and elemental sulfur.

The gold sensitizers applicable to the silver halide emulsions relating to the invention can be added in the forms of chloroauric acid, gold sulfide, gold thiosulfate and, besides, various gold complexes. The ligand compounds applicable thereto include, for example, dimethyl rhodanine, thiocyanic acid, mercaptotetrazole and mercaptotriazole.

The amounts of the gold compounds used may be varied according to the kinds of silver halide emulsions, kinds of the compounds used, the ripening conditions and so forth. However, it is usual that they are used in an amount within the range of, preferably, $1\times10^{-4}$ mols to $1\times10^{-8}$ mols and, particularly, $1\times10^{-5}$ mols to $1\times10^{-8}$ mols, each per mol of silver used.

Any well-known antifoggants and stabilizers may be used in the silver halide emulsions relating to the invention with the purposes of preventing any fog produced during the steps of preparing a silver halide photographic light sensitive material, reducing the characteristic variations in the course of preservation, preventing any fog produced in a development. The compounds capable of satisfying the above-mentioned purposes include, for example, the compounds represented by Formula (II) given in JP OPI Publication No. 2-146036/1990, p.7, in the lower column. The typical compounds thereof include, for example, the compounds (IIa-1) through (IIa-8) and (IIb-1) through (IIb-7) each given in the same JP OPI Publication, and 1- (3-methoxyphenyl) -5-mercaptotetrazole. These compounds are added, for satisfying the purposes, to the step of either preparing silver halide emulsion grains or chemically sensitizing them, after completing the chemical sensitizing step, or the step of preparing a coating solution.

In the case where a silver halide photographic light sensitive material relating to the invention is used as a color photographic light sensitive material, the light sensitive material is to have a layer containing a silver halide emulsion spectrally sensitized to a specific region having a wavelength range of 400 to 900 nm, in combination with yellow, magenta and cyan couplers. Such a silver halide emulsion as mentioned above contains one or more kinds of sensitizing dyes in combination.

The spectrally sensitizing dyes applicable to the silver halide emulsions relating to the invention include, for example, any well-known compounds. The blue-light sensitizing dyes preferably applicable thereto include, for example, BS-1 through BS-8 given in JP OPI Publication No. 3-251840/1991, pp.108~109. The green-light sensitizing dyes preferably applicable thereto include, for example, GS-1 through GS-5 given in the same JP Application, p.110. The red-light sensitizing dyes preferably applicable thereto include, for example, RS-1 through RS-8 given in the same JP OPI Publication, pp.111~112.

When exposing a silver halide photographic light sensitive material relating to the invention to a printer equipped with a semiconductive laser, it is required to use a sensitizing dye having a sensitivity to an infra-red spectral region. The infra-red sensitizing dyes preferably applicable thereto include, for example, IRS-1 through IRS-11 given in JP OPI Publication No. 4-28590/1992, pp.12~14.

It is also allowed that the silver halide photographic light sensitive materials relating to the invention are exposed to laser beam.

As for the laser printers possibly applicable to such a system as mentioned above, there are, for example, those described in JP OPI Publication Nos. 55-4071/1980, 59-11062/1984, 63-197947/1988, 2-74942/1990 and 2-236538/1990, JP Examined Publication No. 56-40822/1981, EPC Patent No. 77410.

As for the reflection type supports relating to the invention, those made of a white pigment-containing polyethylene-coated paper, baryta paper, a vinyl chloride sheet, white pigment-containing polypropylene, polyethylene terephthalate and so forth may be used. Among them, it is preferable to use a support comprising a white pigment-containing polyolefin resin layer on the front surface thereof.

As for the white pigments applicable to the reflection type supports relating to the invention include, there are inorganic and/or organic white pigments and, preferably, inorganic white pigments including, for example, alkaline earth metal sulfates such as barium sulfate, alkaline earth metal carbonates such as calcium carbonate, silicas such as finely powdered silicic acid and synthetic silicate, calcium silicate, alumina, alumina hydrates, titanium oxide, zinc oxide, talc, and clay. The white pigments preferably include, for example, barium sulfate and titanium oxide.

When such a white pigment as mentioned above is to be contained in a water resistive resin layer on the front surface of a reflection type support relating to the invention, the content thereof is advisably not less than 10% by weight, particularly not less than 13% by weight and, preferably not less than 15% by weight. The dispersion degrees of a white pigment contained in the water resistive resin layer of a paper support relating to the invention can be measured in the procedures described in JP OPI Publication No. 2-28640/1990. When measuring the dispersion degrees of a white pigment in the procedures, the dispersion degrees of the white pigment is advisably not more than 0.20, particularly not more than 0.15 and, preferably not more than 0.10, each in terms of the variation coefficient described in the same JP OPI Publication.

In the case of a silver halide photographic light sensitive material relating to the invention, it is also allowed that, after the surface of the support thereof is corona-discharged, UV-ray irradiated or flame treated, then the surface of the support may be coated either directly or through one or more undercoat layers for improving the adhesive property, antistatic property, dimensional stability, antifrictional property, hardness, antihalation property, frictional property and/or other characteristics, each of the support surface.

When a silver halide emulsion is coated, a thickener may also be so used as to improve the coatability. As for the coating processes, an extrusion coating process and a curtain coating process are particularly useful, because tow or more layers can be coated at the same time in these processes.

The aromatic primary amine type developing agents applicable to the invention include, for example, well-known compounds. These compounds include, for example, the following compounds.

| | |
|---|---|
| (CD-1) | N,N-diethyl-p-phenylenediamine |
| (CD-2) | 2-amino-5-diethylaminotoluene |
| (CD-3) | 2-amino-5-(N-ethyl-N-laurylamino)toluene |
| (CD-4) | 4-(N-ethyl-N-[β-hydroxyethyl]amino)aniline |
| (CD-5) | 2-methyl-4-(N-ethyl-N-[β-hydroxyethyl] amino)aniline |
| (CD-6) | 4-amino-3-methyl-N-ethyl-N-[β-(methanesulfonamido)ethyl]aniline |
| (CD-7) | N-(2-amino-5-diethylaminophenylethyl) methanesulfonamide |
| (CD-8) | N,N-dimethyl-p-pheny-lenediamine |
| (CD-9) | 4-amino-3-methyl-N-ethyl-N-methoxyethylaniline |
| (CD-10) | 4-amino-3-methyl-N-ethyl-N-(β-ethoxyethyl)aniline |
| (CD-11) | 4-amino-3-methyl-N-ethyl-N-(β-butoxyethyl)aniline |

When these compounds are used in the image forming processes relating to the invention, the compounds represented by the following Formula 2 may preferably be used, particularly from the viewpoint for carrying out a rapid development.

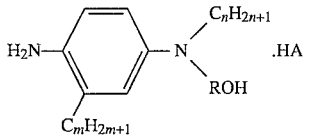

Formula 2 wherein R represents a straight-chained or branched alkylene group having 3 carbon atoms; m and n are each an integer of 1 to 4, respectively; and HA represents an inorganic or organic acid such as hydrochloric acid, sulfuric acid, nitric acid or p-toluenesulfonic acid.

These color developing agents can readily be synthesized in the procedures mentioned in, for example, Journal of American Chemical Society, Vol.73, No.3100, (1951).

The typical examples of the moiety of amine base of the compounds represented by Formula 2 will be given below.

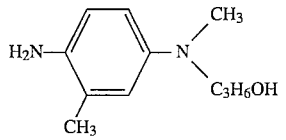

2-1

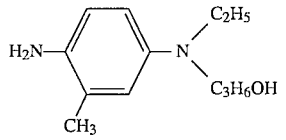

2-2

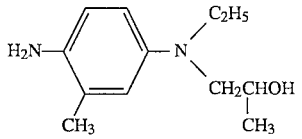

2-3

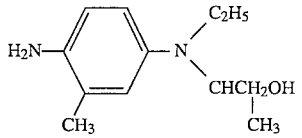

2-4

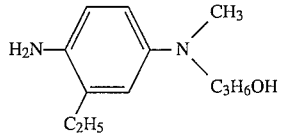

2-5

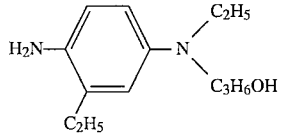

2-6

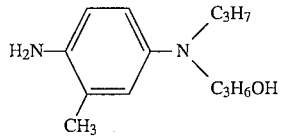

2-7

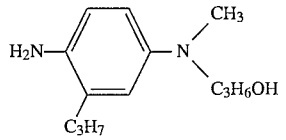

2-8

-continued

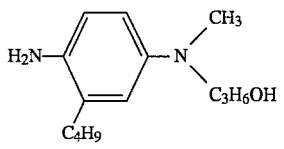

2-9

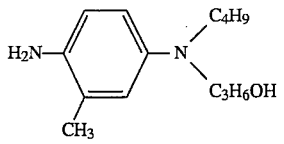

2-10

The color developing agents relating to the invention are commonly used in an amount within the range of $1\times10^{-2}$ to $2\times10^{-1}$ mols per liter of a developer used. From the rapid processing viewpoint, they are preferably used in an amount within the range of $1.5\times10^{-2}$ to $2\times10^{-1}$ mols per liter of a color developer used.

The color developing agents applicable to the image forming processes relating to the invention may also be used independently or in combination with other well-known p-phenylenediamine derivatives. In the image forming processes relating to the invention, the compounds, which are used therein with the compounds represented by Formula 2 in combination, include preferably (CD-5), (CD-6) and (CD-9).

These p-phenylenediamine derivatives are generally used in the form of salt such as a sulfate, hydrochloride, sulfite, nitrate, p-toluenesulfonate.

The color developers relating to the invention are allowed to contain the following developer components, besides the above-given components. As for the alkali agents, sodium hydroxide, potassium hydroxide, sodium metaborate, potassium metaborate, trisodium phosphate, tripotassium phosphate, borax, silicate and so forth, for example, may be used independently or in combination, provided that no precipitation can be produced and the pH stabilizing effects can be maintained. For the necessity of chemical preparation or for enhancing the ionic strength, it is also allowed to use a variety of salts such as disodium hydrogen phosphate, dipotassium hydrogen phosphate, sodium hydrogen carbonate, potassium hydrogen carbonate and borate.

In the image forming processes relating to the invention, chloride ions are used in the color developers therefor. Potassium chloride, sodium chloride and so forth are used therein. The amount of these ions used therein is normally not less than $6.0\times10^{-2}$ mols and, preferably within the range of $8.0\times10^{-2}$ to $2.0\times10^{-1}$ mols, each per liter of a color developer used.

Bromide ions may also be used, provided, the effects of the invention shall not be spoiled. It is, however, preferable to use them in an amount of not more than $1.0\times10^{-3}$ mols and, preferably not more than $5.0\times10^{-4}$ mols, each per liter of a color developer used, because they have a great development inhibition effect.

If required, a development accelerator may further be used. The development accelerators include, for example, a variety of the pyridinium compounds typified in U.S. Pat. Nos. 2,648,604 and 3,671,247, and JP Examined Publication No. 44-9503/1969; other cationic compounds; cationic dyes such as phenosafranine; neutral salts such as thallium nitrate; polyethylene glycols and the derivatives thereof such as given in U.S. Pat. Nos. 2,533,990, 2,531,832, 2,950,970 and 2,577,127 and JP Examined Publication No. 44-9504/1969; Nonionic compounds such as polythioethers; Organic solvents and organic amines such as given in JP Examined Publication No. 44-9509/1969; ethanol amine; ethylenediamine; diethanolamine; and triethanolamine. The development accelerators further include, for example, phenethyl alcohol given in U.S. Pat. No. 2,304,925 and, besides, acetylene glycol, methylethyl ketone, cyclohexanone, pyridine, ammonia, hydrazine, thioethers and amines.

To the color developers relating to the invention, if required, ethylene glycol, methyl cellosolve, methanol, acetone, dimethyl formamide, β-cyclodextrin, or other compounds given in JP Examined Publication Nos. 47-33378/1972 and 44-9509/1969 may be used as an organic solvent so as to enhance the solubility of the developing agent of the color developer used.

It is further allowed to use an auxiliary developing agent together with a developing agent. As for the auxiliary developing agents, those of N-methyl-p-aminophenol sulfate, phenidone, N,N-diethyl-p-aminophenol hydrochloride and N,N,N',N'-tetramethyl-p-phenylenediamine hydrochloride, for example, are each well known. They may be usually added in an amount within the range of 0.01 to 1.0 g per liter of a developer used. Besides the above, it is further allowed to add a competing coupler, a foggant, a development inhibitor-releasing type coupler (so-called a DIR coupler), a development inhibitor-releasing type compound and so forth, if occasion demands.

In addition to the above, various additives such as other anti-staining agents, anti-sludging agents and interlayer effect accelerators may be used.

Each of the above-mentioned color developer components can be prepared by adding and stirring them into a certain amount of water in order. In this case, if some components are lower in solubility to water, they may be added to water after they are mixed with the aforementioned organic solvent such as triethanolamine. More popularly, a color developer relating to the invention is also prepared in such a manner that plural components capable of stably coexisting with each other are prepared to be a concentrated aqueous solution or in the solid form and then put into a small container in advance so that the contents of the container can be added to and stirred in water.

In the invention, the color developers may be used in any pH ranges. From the rapid processing viewpoint, they are used in a pH range of, preferably 9.5 to 13.0 and, particularly 9.8 to 12.0.

The temperature for the color developments relating to the invention is preferably within the range of not lower than 35° C. to not higher than 70° C.

The higher the temperature, the shorter the processing. However, it is not advisable to raise the temperature too higher from the viewpoint of the stabilities of processing solutions. It is therefore preferable to carry out a processing at a temperature between not lower than 37° C. and not higher than 60° C.

Generally, the color development have been carried out so far for about 3 minutes 30 seconds. In the invention, however, it is advisable to carry out color developments within 30 seconds, preferably within 20 seconds and, particularly within the range of 20 to 3 seconds.

The processing steps are substantially comprised of a color developing step, a bleach-fixing step, and a washing step, including a stabilizing step in place of the washing step. It is, however, allowed to supplement an additional processing step or to replace the above-mentioned processing steps by other processing steps having the equivalent functions, provided that the effects of the invention shall not be spoiled. For example, the bleach-fixing step can also be separated into a bleaching step and a fixing step, or an additional bleaching step can further be carried out before the above-mentioned bleach-fixing step. As for the processing steps to be carried out in the process of the invention, it is preferable to carry out a bleach-fixing step immediately after completing a color developing step.

There is no limitation to the bleaching agents applicable to the bleach-fixers used in the image forming processes of the invention. However, these bleaching agents are preferably the metal complex salts of an organic acid. The complex salts thereof are, for example, those having metal ions of iron, cobalt or copper, coordinated by polycarboxylic acid, aminopolycarboxylic acid or an organic acid such as oxalic acid and citric acid. The preferable organic acids applicable to form the above-mentioned metal complex salts include, for example, polycarboxylic acid or aminopolycarboxylic acid. These polycarboxylic acid or aminopolycarboxylic acid may also be those of alkali metal salts, ammonium salts or water-soluble amine salts.

The typical compounds thereof include, for example, the compounds [2] through [20] each given in JP OPI Publication No. 1-205262/1989.

These bleaching agents may be used in an amount within the range of 5 to 450 g and, preferably 20 to 250 g, each per liter of a bleach-fixer used. The above-mentioned bleach-fixers contain each a silver halide fixer, besides the above-mentioned bleachers and, if required, the bleach-fixers are also allowed to contain a solution having a composition containing a sulfite so that the solution can serve as a preservative.

Besides an iron (III) ethylenediaminetetraacetate bleaching agent and the above-mentioned silver halide fixer, it is also allowed to use a bleach-fixer having a composition added by a large amount of halides such as ammonium bromide, another peculiar bleach-fixer having a composition comprising the combination of an iron (III) ethylenediaminetetraacetate bleaching agent and a large amount of halides such as ammonium bromide, and so forth. The above-mentioned silver halides applicable thereto also include, for example, hydrochloric acid, hydrobromic acid, lithium bromide, sodium bromide, potassium bromide, sodium iodide, potassium iodide and ammonium iodide, as well as ammonium bromide.

As for the above-mentioned silver halide fixers to be contained in the bleach-fixers, the following typical examples thereof may be given. Namely, the compounds capable of producing a water-soluble complex salt upon making reaction with silver halides, including those applicable to an ordinary fixing treatment. These compounds include, typically, thiosulfates such as potassium thiosulfate, sodium thiosulfate and ammonium thiosulfate, thiocyanates such as potassium thiocyanate, sodium thiocyanate and ammonium thiocyanate, thioureas and thioethers. These fixers may be used in an amount of not less than 5 g per liter of a bleach-fixer used, provided that the fixer can be dissolved. It is usual that the fixers are used in an amount within the range of 70 to 250 g per liter of a bleach-fixer used. Further, the bleach-fixers are also allowed to contain a variety of pH buffers independently or in combination, such as boric acid, borax, sodium hydroxide, potassium hydroxide, sodium carbonate, potassium carbonate, sodium bicarbonate, potassium bicarbonate, acetic acid, sodium acetate and ammonium hydroxide. In addition to the above, it is further allowed to contain therein a variety of fluorescent whitening agents, defoamers or surfactants.

It is still further allowed to suitably contain therein the following compounds, namely; a preservative such as the bisulfite adducts of hydroxylamine, hydrazine or aldehyde compounds; an organic chelating agent such as aminopolycarboxylic acid; a stabilizer such as nitroalcohol and nitrates; and an organic solvent such as methanol, dimethyl sulfonamide and dimethylsulfoxide. To the bleach-fixers relating to the invention, it is also allowed to add a variety of bleach-accelerators including, for example, those described in JP OPI Publication No. 46-280/1971, JP Examined Publication Nos. 45-8506/1970 and 46-556/1971, Belgian Patent No. 770,910, JP Examined Publication Nos. 45-8836/1970 and 53- 9854/1978, and JP OPI Publication Nos. 54-71634/1979 and 49- 42349/1974.

The above-mentioned bleach-fixers are used at a pH of not lower than 4.0, usually at a pH within the range of 4.0 to 9.5, preferably 4.5 to 8.5 and, more preferably 5.0 to 8.5. The processing temperature is to be not higher than 80° C. and preferably not higher than 55° C. so as to inhibit an evaporation. The bleach-fixing time is to be within the range of, preferably 3 to 45 seconds and, more preferably 5 to 30 seconds.

In the developing steps relating to the invention, after the above-mentioned color developing and bleach-fixing steps, a washing step will follow. Now, one of the preferable embodiments of the washing step will be detailed.

As for the compounds preferably used in washing solutions, chelating agents each having an iron ion chelating stability constant of not less than 8 are preferably used. The term, 'a chelating stability constant', herein means a constant generally known from L. G. Sillen & A. E. Martell, "Stability Constants of Metalion Complexes", The Chemical Society, London, (1964), Chaberek & A. E. Martell, "Organic Sequestering Agents", Wiley, (1959), and so forth.

The chelating agents, which are preferably applicable to washing solutions so as to have an iron ion chelating stability constant of not less than 8, include, for example, an organic carboxylic acid chelating agent, an organic phosphoric acid chelating agent, an inorganic phosphoric acid chelating agent and a polyhydroxy compound. The above-mentioned iron ions herein mean ferric ions.

Among the chelating agents each having a ferric ion chelating stability constant of not less than 8, the typical examples thereof include the compounds given in JP OPI Publication No. 1-205162/1989, p. 63, 15th line to p. 64, 17th line.

The above-mentioned chelating agents may be used in an amount within the range of, advisably 0.01 to 50 g and, preferably 0.05 to 20 g, each per liter of a washing solution used.

Further, the compounds particularly preferable to be added to a washing solution include, for example, ammonium compounds. These compounds may be supplied by the ammonium salts of various inorganic compounds and they include, typically, the compounds given in JP OPI Publication No. 1- 205162/1989, p.65, 5th line to p.66, 11th line. These ammonium compounds may be added in an amount of, preferably not less than $1.0\times10^{-5}$ mols, within the range of, particularly 0.001 to 5.0 mols and, most preferably 0.002 to 1.0 mols, each per liter of a washing solution used.

It is preferable that a washing solution contains a sulfite, provided that no bacterium can be generated. The sulfites to be contained in the washing solutions may be any ones such as organic or inorganic substances, provided that the sulfites can release sulfite ions. However, they are preferably inorganic salts including typically sodium sulfite, potassium sulfite, ammonium sulfite, ammonium bisulfite, potassium bisulfite, sodium bisulfite, sodium metabisulfite, potassium metabisulfite, ammonium metabisulfite, hydrosulfite, sodium glutalaldehyde bis-sodium solfite, and succinaldehyde bis-sodium solfite.

The above-mentioned sulfites may be added in an amount of, preferably at least $1.0\times10^{-5}$ mols and, more preferably within the range of $5\times10^{-5}$ to $1.0\times10^{-1}$ mols, each per liter of a washing solution used. They may be added directly to a washing solution and, preferably to a washing solution replenisher in advance.

The washing solutions applicable to the invention are preferable to contain an antimold and, thereby the improvements of sulfurization prevention of the solution and image preservability can be performed. The antimolds applicable to the washing solutions relating to the invention include, for example, sorbic acid, benzoic acid type compounds, phenol type compounds, thiazole type compounds, pyridine type compounds, guanidine type compounds, morpholine type compounds, quaternary phosphonium type compounds, ammonium type compounds, urea type compounds, isoxazole type compounds, propanolamine type compounds, silfamide type compounds, pyronone type compounds and amino type compounds. The typical compounds thereof include, for example, those given in JP OPI Publication No. 1-205162/1989, p.68, 10th line to p.72, 16th line. Among them, the particularly preferable compounds include, for example, thiazole type compounds, silfamide type compounds and pyronone type compounds.

The above-mentioned antimolds may be added to a washing solutions, each in an amount within the range of, advisably 0.001 to 30 g and, preferably 0.003 to 5 g, each per liter of a washing solution used.

It is preferable that the washing solutions relating to the invention contain each a chelating agent and a metal compound in combination. The metal compounds include, for example, those of Ba, Ca, Ce, Co, In, La, Mn, Ni, Bi, Pb, Sn, Zn, Ti, Zr, Mg, Al or Sr. These metal compounds may be supplied in the forms of inorganic or organic salts such as halides, sulfates, carbonates, phosphates and acetates, the hydroxides thereof, or water-soluble chelated compounds. They may be added in an amount within the range of, advisably $1.0\times10^{-4}$ to $1.0\times10^{-1}$ mols and, preferably $4.0\times10^{-4}$ to $2.0\times10^{-2}$ mols, each per liter of a washing solution used.

As for the compounds to be contained in the washing solutions relating to the invention, a compound having an aldehyde group may also be used, as well as the above-given compounds. The typical compounds thereof include, for example, the exemplified compounds 1 through 32 given in JP OPI Publication No. 1-205162/1989, pp. 73~75.

The above-mentioned compounds each having an aldehyde group are used in an amount within the range of, advisably 0.1 to 50 g and, particularly 0.5 to 10 g, each per liter of a washing solution used.

As for the washing solutions relating to the invention, ion-exchange water treated with an ion-exchange resin may also be used.

The washing solutions applicable to the invention are to have a pH within the range of 6.5 to 10.0. The pH controllers applicable to the invention include, for example, any generally known alkali agents and acid agents.

The temperatures for the washing treatments are to be within the range of, preferably 15° to 60° C. and, more preferably 20° to 45° C. The time for the washing treatments are to be within the range of, preferably 5 to 60 seconds and, more preferably 5 to 50 seconds. In the case where a washing step is carried out in plural tanks, it is preferable that the washing time is made shorter in the preceding tank than in the following tank. It is particularly preferable that every washing time is prolonged by 20 to 50% in order from the preceding tanks to the following tanks.

In the washing steps relating to the invention and when a multiple-tank counter-flow current system is adopted, the washing solution is supplied to the succeeding tank and is then overflown therefrom into the preceding tank. It is the matter of course that the washing treatment can also be made in a single tank. As for the methods for adding the aforementioned compounds, there are various methods including, for example, a method in which the concentrated solution of a subject compound is prepared and it is then added to a washing tank and another method in which a subject compound and other additives are added in advance to a washing solution to be supplied to a washing tank and the resulting solution is used as a washing solution replenisher.

In the washing steps relating to the invention, the amount of washing solution per unit area of a subject light sensitive material is preferably 0.1 to 50 times and more preferably 0.5 to 30 times as much as the amount brought-in from the preceding bath, that is usually a bleach-fixer or a fixer.

In the washing steps relating to the invention, the washing tank system is comprised of, preferably 1 to 5 tanks and more preferably 1 to 3 tanks.

As for the silver halide photographic light sensitive material development apparatuses to be used in the image forming processes of the invention, the following apparatuses, for example, are used; namely, a roller-transport type apparatus in which a subject light sensitive material is sandwiched between the rollers provided each to a processing tank, and an endless-belt type apparatus in which a subject light sensitive material is fixed onto the belt and is then conveyed.

In the processes of the invention, there is no limitation to the time required from an exposure to a development. It is, however, preferable to make it shorter, for making the whole processing time shorter.

The silver halide photographic light sensitive materials of the invention can be used advantageously, because image density variations can be reduced and high-quality images can stably be obtained even when the time from an exposure to a development is not longer than 30 seconds.

EXAMPLES

Example 1

A paper support was prepared by laminating high-density polyethylene on both surfaces of a base paper having an amount by weight of 180 g/m$^2$. In the polyethylene layer provided on the side of the paper support where an emulsion layer is to be coated, surface-treated anatase type titanium oxide is dispersed therein in a content of 15% by weight. Each of the layers having the following compositions was coated on the resulting reflection type support, so that multilayered silver halide photographic light sensitive material sample 101 could be prepared. The coating solutions were each prepared as follows.

Ethyl acetate of 60 ml was added to 26.7 g of yellow coupler (Y-1), 0.67 g of additive (HQ-1) and 6.67 g of high-boiling organic solvent (DNP), and the mixture was then dissolved up. The resulting solution was dispersed by making use of a supersonic homogenizer into 220 ml of an aqueous 10% gelatin solution containing 9.5 ml of 15% surfactant (SU-1), so that a yellow coupler dispersed solution could be prepared.

The resulting dispersion was mixed up with a blue light-sensitive silver halide emulsion, containing 8.68 g of silver, prepared under the following conditions, so that the coating solution for layer-1 could be prepared. The coating solutions for layer-2 through layer-7 were each prepared in the similar manner as in the above-mentioned coating solution for layer-1. Besides, as the hardeners, (H-1) was added to each of layer-2 and layer-4, and (H-2) to layer-7, respectively. As the coating aids, surfactants (SU-2) and (SU-3) were so added as to adjust the surface tension.

The compositions of the layers will be shown in the following table.

TABLE 1

| Layer | Composition | Amount added (g/m$^2$) |
|---|---|---|
| Layer-7 | Gelatin | 1.00 |
| (a protective layer) | Antistaining agent (HQ-2) | 0.002 |
| | Antistaining agent (HQ-3) | 0.002 |
| | Antistaining agent (HQ-4) | 0.004 |
| | Antistaining agent (HQ-5) | 0.02 |
| | Compounds B, C, D, E | $2 \times 10^{-5}$ each |
| | DIDP | 0.005 |
| | Silicon dioxide | 0.003 |
| | Antimold (F-1) | 0.002 |
| Layer-6 | Gelatin | 0.40 |
| (a UV absorbing layer) | AI-2 | 0.02 |
| | AI-4 | 0.01 |
| | UV absorbent (UV-1) | 0.10 |
| | UV absorbent (UV-2) | 0.04 |
| | UV absorbent (UV-3) | 0.16 |
| | Antistaining agent (HQ-5) | 0.04 |
| | Compound E | $4 \times 10^{-4}$ |
| | Compounds F, G | $2 \times 10^{-4}$ each |
| | PVP | 0.03 |
| Layer-5 | Gelatin | 1.30 |
| (a red-sensitive layer) | Red-sensitive silver chlorobromide emulsion (Em-R) | 0.21 |
| | Cyan coupler (C-1) | 0.10 |
| | Cyan coupler (C-2) | 0.28 |
| | Dye-image stabilizer (ST-1) | 0.20 |
| | Antistaining agent (HQ-1) | 0.01 |
| | HBS-1 | 0.20 |
| | DOP | 0.20 |
| Layer-4 | Gelatin | 0.94 |
| (a UV absorbing layer) | UV absorbent (UV-1) | 0.28 |
| | UV absorbent (UV-2) | 0.09 |
| | UV absorbent (UV-3) | 0.38 |
| | Compounds F, G | $4 \times 10^{-4}$ each |
| | Antistaining agent (HQ-5) | 0.10 |
| | Compound E | $1 \times 10^{-3}$ |
| Layer-3 | Gelatin | 1.40 |
| (a green-sensitive layer) | AI-1 | 0.01 |
| | Green-sensitive silver chlorobromide emulsion (Em-G) | 0.17 |
| | Magenta coupler (M-1) | 0.23 |
| | Dye-image stabilizer (ST-3) | 0.20 |
| | Dye-image stabilizer (ST-4) | 0.17 |
| | DIDP | 0.13 |
| | DBP | 0.13 |
| Layer-2 | Gelatin | 1.20 |
| (an intermediate layer) | AI-3 | 0.01 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | Compounds B, C, D, E | $3 \times 10^{-4}$ each |
| | DIDP | 0.06 |
| | Fluorescent whitening agent (W-1) | 0.10 |
| | Antimold (F-1) | 0.02 |
| Layer-1 | Gelatin | 1.20 |
| (a blue-sensitive layer) | Blue-sensitive silver chlorobromide emulsion (Em-B) | 0.26 |
| | Yellow coupler (Y-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Compound A | $2 \times 10^{-4}$ |
| | DNP | 0.20 |
| | Compound of Formula 1 or comparative compound | 0.10 |
| Support | Polyethylene-laminated paper (having a small content of a colorant) | |

In the above, the amounts of the silver halide emulsions added are indicated by the corresponding silver contents.

Comparative compound (A)
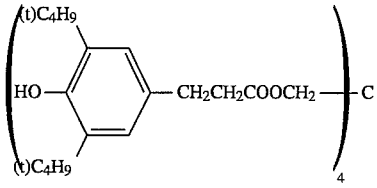
Comparative compound (B)
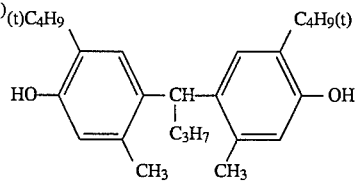
Comparative compound (C)
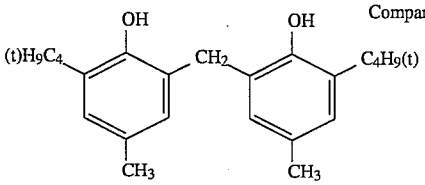
Y-1
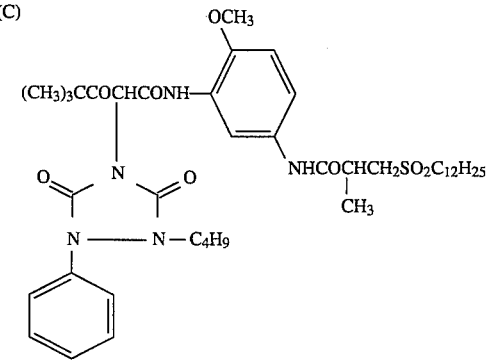
M-1
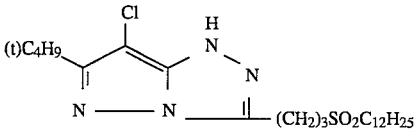
C-1
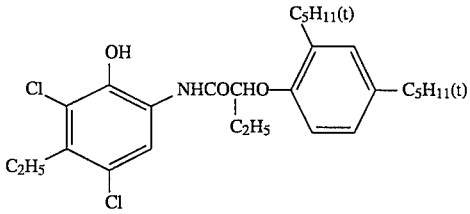
C-2
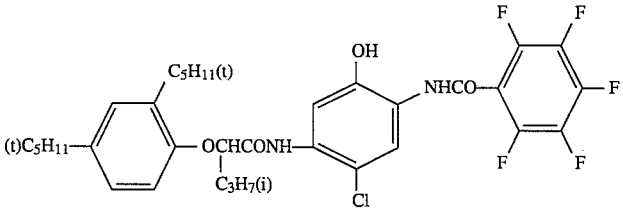
ST-1
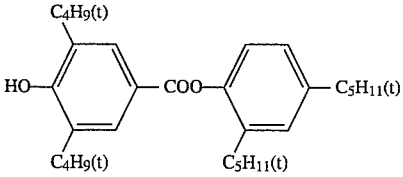
ST-2
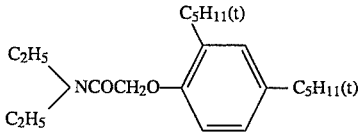
ST-3
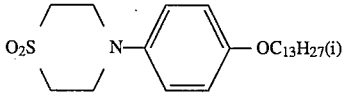
ST-4
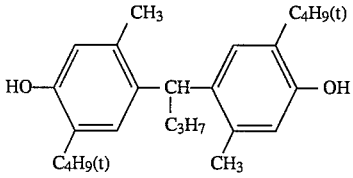
UV-1
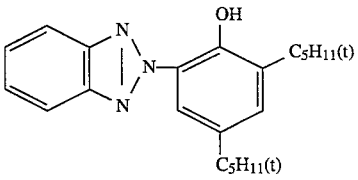
UV-2
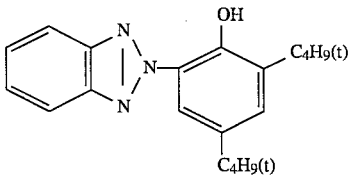

-continued
UV-3
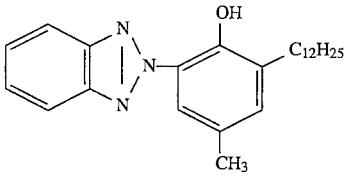
DOP: Dioctyl phthalate
DIDP: Diisodecyl phthalate
DBP: Dibutyl phthalate
DNP: Dinonyl phthalate
PVP: Polyvinyl pyrrolidone
HQ-1
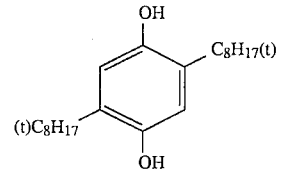
HQ-2
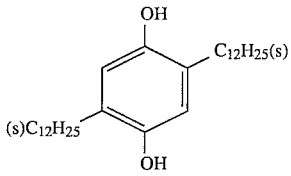
HQ-3
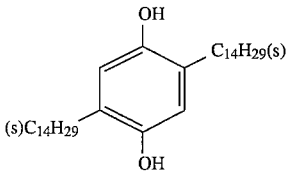
HQ-4
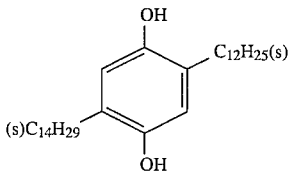
HQ-5
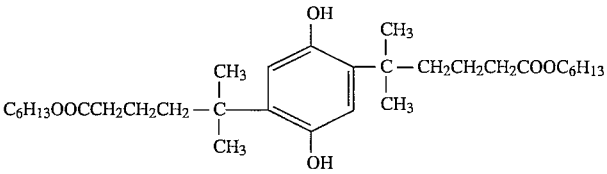
Compounds A,B,C,D,E (the quinone form compounds of HQ- 1,2,3,4,5, respectively)
Compound F
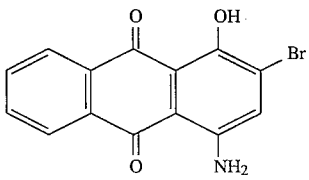
Compound G
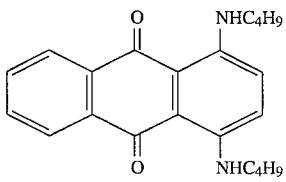
HBS-1
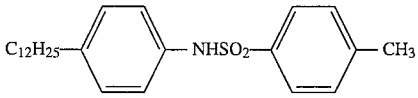
SU-1
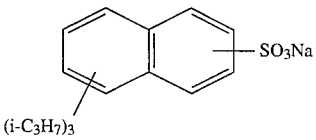
AI-1
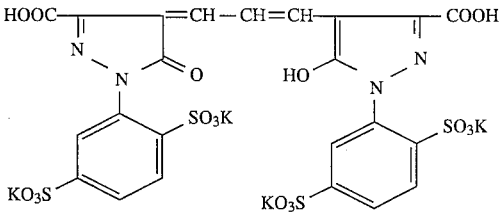

-continued

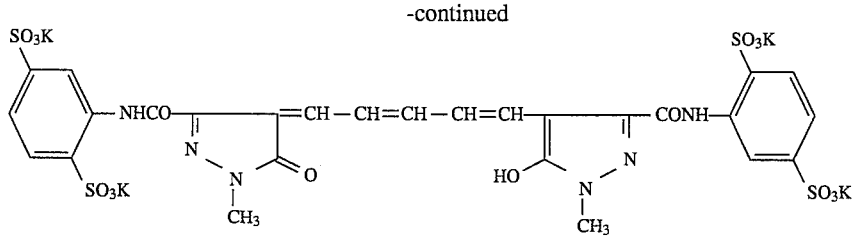

AI-2

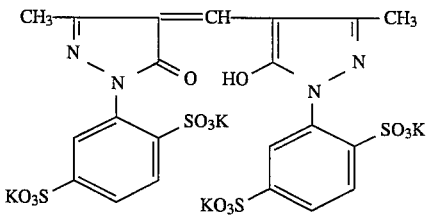

AI-3

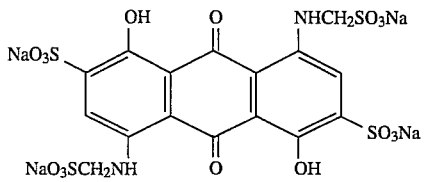

AI-4

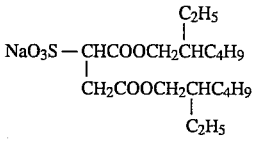

SU-2

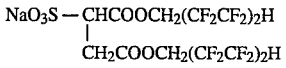

SU-3

$C(CH_2SO_2CH{=}CH_2)_4$

H-1

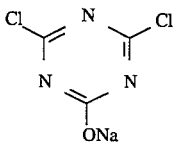

H-2

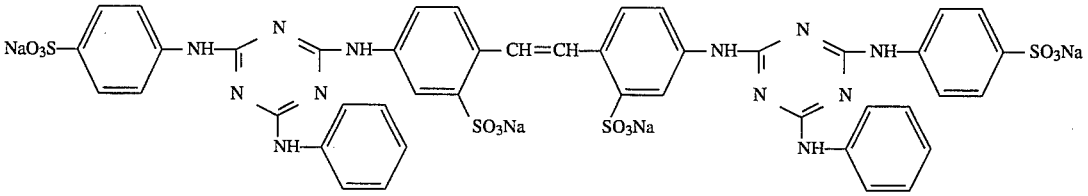

W-1

Mixture of

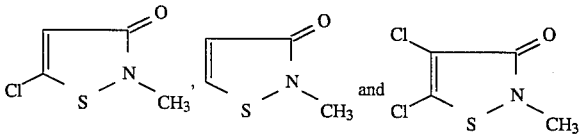

F-1

(50%) (46%) and (4%) in mol ratio

Preparation of Blue-Sensitive Silver Halide Emulsion

To 1000 ml of an aqueous 2% gelatin solution being kept at 40° C., the following Solutions A and Solution B were simulateneously added by taking 30 minutes while keeping pAg=6.5 and pH=3.0 and, further, the following Solutions C and Solution D were simulateneously added by taking 180 minutes while keeping pAg=7.3 and pH=5.5.

At this time, the pAg controls were carried out in the method described in JP OPI Publication No. 59-45437/1984 and the pH controls were carried out by making use of an aqueous sulfuric acid or sodium hydroxide solution.

| (Solution A) | |
|---|---|
| Sodium chloride | 3.42 g |
| Potassium bromide | 0.07 g |
| Add water to make | 200 ml |
| (Solution B) | |
| Silver nitrate | 10 g |
| Add water to make | 200 ml |
| (Solution C) | |
| Sodium chloride | 102.7 g |
| Potassium bromide | 2.10 g |
| Add water to make | 600 ml |
| (Solution D) | |
| Silver nitrate | 300 g |
| Add water to make | 600 ml |

After completing the addition, a desalting treatment was carried out by making use of an aqueous solution of 5% Demol N (manufactured by Kao Corp.) and an aqueous 20% magnesium sulfate solution and the resulting desalted emulsion was mixed with an aqueous gelatin solution, so that monodisperse type cubic emulsion EMP-1 having an average grain size of 0.85 μm, a variation coefficient (σ/R) of 0.07 and a silver chloride content of 99.0 mol % could be prepared.

The resulting emulsion EMP-1 was chemically ripened by making use of the following compounds at 50° C. for 90 minutes, so that blue-sensitive silver halide emulsion Em-B could be prepared. In the followings AgX means silver halide.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Preparation of Green-Sensitive Silver Halide Emulsion

Monodisperse type cubic emulsion EMP-2 having an average grain size of 0.43 μm, a variation coefficient (σ/R) of 0.07 and a silver chloride content of 99.0 mol % could be prepared in the same manner as in the case of EMP-1, except that the adding time of both Solution A and Solution B and the adding time of both Solution C and Solution D were each changed. EMP-2 was chemically ripened by making use of the following compounds at 55° C. for 120 minutes, so that green-sensitive silver halide emulsion Em-G could be prepared.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Preparation of Red-Sensitive Silver Halide Emulsion

Monodisperse type cubic emulsion EMP-3 having an average grain size of 0.50 μm, a variation coefficient (σ/R) of 0.08 and a silver chloride content of 99.0 mol % could be prepared in the same manner as in the case of EMP-1, except that the adding time of both Solution A and Solution B and the adding time of both Solution C and Solution D were each changed.

EMP-3 was chemically ripened by making use of the following compounds at 60° C. for 90 minutes, so that red-sensitive silver halide emulsion Em-R could be prepared.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{4}$ mols/mol of AgX |

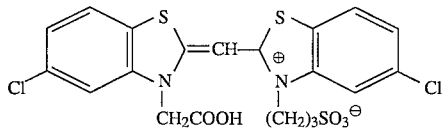

BS-1

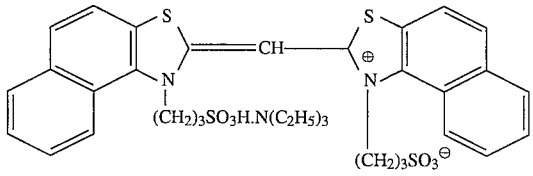

BS-2

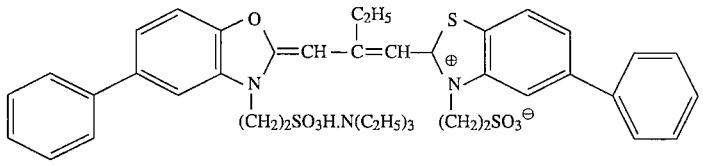

GS-1

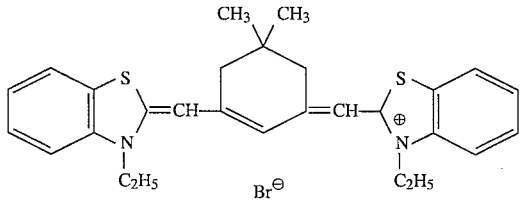

RS-1

-continued

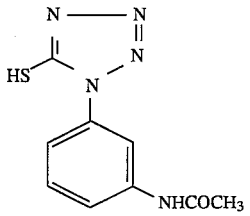

STAB-1

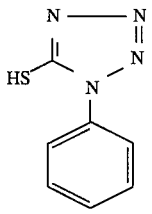

STAB-2

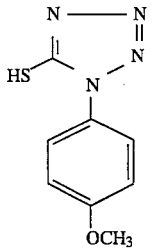

STAB-3

A series of the samples Samples 102–108, were prepared in the same manner as in the preparation of Sample 101, except that each of the compounds represented by Formula 1 was or comparative compound (A) , (B) or (C) added as shown in Table 3, into layers 1.

Each of the resulting samples was exposed to blue light through an optical wedge for 0.5 seconds in an ordinary method and was then developed in the following processing steps.

(Processing steps)

| Processing step | Processing temperature | Processing time | Amount replenished |
|---|---|---|---|
| Color developing | 38.0 ± 0.3° C. | 27 sec. | 81 ml/m$^2$ |
| Bleach-fixing | 35.0 ± 0.5° C. | 27 sec. | 54 ml/m$^2$ |
| Stabilizing | 30~34° C. | 90 sec. | 150 ml/m$^2$ |
| Drying | 60~80° C. | 30 sec. | |

The compositions of the processing solutions will be given below.

(Color developer tank solution)

| | |
|---|---|
| Pure water | 800 ml |
| Diethylene glycol | 10 g |
| Potassium bromide | 0.01 g |
| Potassium chloride | 3.5 g |
| Potassium sulfite | 0.25 g |
| N-ethyl-N-(β-methanesulfonamidoethyl)-3-methyl-4-aminoaniline sulfate | 6.5 g |
| N,N-diethylhydroxylamine | 3.5 g |
| Di(ethaxysulfonyl)hydroxylamine | 3.5 g |
| Triethanolamine | 10.0 g |
| Sodium diethylenetriaminepentaacetate | 2.0 g |
| Fluorescent whitening agent, (a 4,4'-diaminostilbene sulfonic acid derivative) | 2.0 g |
| Potassium carbonate | 30 g |
| Add water to make in total of | 1 liter |
| Adjust pH to be | pH = 10.10 |

-continued (Color developer replenisher)

| | |
|---|---|
| Pure water | 800 ml |
| Diethylene glycol | 10 g |
| Potassium sulfite | 0.5 g |
| N-ethyl-N-(β-methanesulfonamidoethyl)-3-methyl-4-aminoaniline sulfate | 10.5 g |
| N,N-diethylhydroxylamine | 6.0 g |
| Di(ethaxysulfonyl)hydroxylamine | 6.0 g |
| Triethanolamine | 10.0 g |
| Sodium diethylenetriaminepentaacetate | 2.0 g |
| Fluorescent whitening agent, (a 4,4'-diaminostilbene sulfonic acid derivative) | 2.5 g |
| Potassium carbonate | 30 g |
| Add water to make in total of | 1 liter |
| Adjust pH to be | pH = 10.60 |

| (Bleach-fixing solution) | Replenisher | Tank solution |
|---|---|---|
| Ferric ammonium diethylenetriamine pentaacetate dehydrate | 100 g | 50 g |
| Diethylenetriamine pentaacetic acid | 3 g | 3 g |
| Ammonium thiosulfate, (in an aqueous 70% solution) | 200 ml | 100 ml |
| 5-amino-1,3,4-thiadiazole-2-thiol | 2.0 g | 1.0 g |
| Ammonium sulfite, (in an aqueous 40% solution) | 50 ml | 25 ml |
| | pH 6.5 | 7.0 |

Add water to make in total of 1 liter.

Adjust pH with aqueous ammonia or glacial acetic acid.

| (Stabilizer tank solution and Replenisher) | |
|---|---|
| Orthophenyl phenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent whitening agent (Tinopal SFP) | 2.0 g |
| 1-hydroxyethylidene-1,1-diphosphonic acid | 1.8 g |
| PVP (polyvinyl pyrrolidone) | 1.0 g |
| Aqueous ammonia (in an aqueous 25% ammonium hydroxide solution) | 2.5 g |
| Ethylenediaminetetraacetic acid | 1.0 g |
| Ammonium sulfite (in an aqueous 40% solution) | 10 ml |
| Add water to make in total of | 1 liter |
| Adjust pH with sulfuric acid or aqueous ammonia to be | pH = 7.5 |

In the stabilizing step, the replenishment was carried out in a three-tank multistaged counter-current system.

A running processing was carried out by making use of the resulting color paper and processing solutions. In the running treatment, the above-mentioned color developer, bleach-fixing tank solution and stabilizing tank solution were filled up in an automatic processor and the above-mentioned color developer replenisher, bleach-fixer replenisher and stabilizer replenisher were each replenished every three minutes, while the color paper sample was being treated.

Further, processing solutions were each prepared in which the chlorine ion concentration of each color developing running solution was changed by making use of KCl, as shown in Tables 3~4, and the samples were each treated with the resulting processing solutions, respectively.

With the resulting color developed samples, the color developability, white background property and sweat resistivity thereof were measured as follows.

Color Developability

The maximum color densities of the resulting color developed samples were each measured by making use of a densitometer, Model PDA-65 (manufactured by Konica Corp.).

Whiteness of Background

In the white background portions unexposed to light, the blue light reflection densities of the samples were each measured by a densitometer, Model PDA-65.

Light Fastness Test

With the samples, the green light reflection densities thereof were each measured by making use of a densitometer, Model PDA-65, before and after the discoloration produced when the samples were each exposed to sunlight for 30 days on an underglass outdoor exposure table. The degrees of the discoloration produced by an exposure to light (or, discoloration ratios) were obtained in the following manner.

Discoloration ratio=$100\times(D-D_0/D_0)$, wherein $D_0$=A density (1.0) obtained before a discoloration is produced; and D=A density obtained after a discoloration is produced.

Sweat Resistivity

After the samples were each stored at 85° C. and 60% RH for 3 weeks, the sweated out conditions on the surfaces thereof were observed.

The results of the above-mentioned measurements will be shown in the following Table 3.

TABLE 3

| Sample No. | Experiment No. | Compound of Formula 1 | Chlorine-ion concentration in color developer (mol/l) | Whiteness of background (Dmin) | Color developability (Dmax) | Light fastness, Discoloration ratio, (%) | Sweating condition | Remarks |
|---|---|---|---|---|---|---|---|---|
| 101 | 1 | Not added | $1\times10^{-2}$ | 0.12 | 2.25 | 35 | Not sweated | Comparison |
| | 2 | Not added | $4\times10^{-2}$ | 0.12 | 2.24 | 35 | Not sweated | Comparison |
| | 3 | Not added | $6\times10^{-2}$ | 0.12 | 2.15 | 36 | Not sweated | Comparison |
| | 4 | Not added | $8\times10^{-2}$ | 0.11 | 2.10 | 35 | Not sweated | Comparison |
| 102 | 5 | Comparative compound (A) | $1\times10^{-2}$ | 0.12 | 2.15 | 26 | Sweated | Comparison |
| | 6 | Comparative compound (A) | $4\times10^{-2}$ | 0.11 | 2.13 | 25 | Sweated | Comparison |
| | 7 | Comparative compound (A) | $6\times10^{-2}$ | 0.10 | 2.10 | 25 | Sweated | Comparison |
| | 8 | Comparative compound (A) | $8\times10^{-2}$ | 0.10 | 2.08 | 25 | Sweated | Comparison |
| 103 | 9 | Comparative compound (B) | $1\times10^{-2}$ | 0.12 | 2.05 | 29 | Not sweated | Comparison |
| | 10 | Comparative compound (B) | $4\times10^{-2}$ | 0.11 | 2.02 | 28 | Not sweated | Comparison |
| | 11 | Comparative compound (B) | $6\times10^{-2}$ | 0.10 | 1.92 | 29 | Not sweated | Comparison |
| | 12 | Comparative compound (B) | $8\times10^{-2}$ | 0.10 | 1.90 | 28 | Not sweated | Comparison |
| 104 | 13 | Comparative compound (C) | $1\times10^{-2}$ | 0.12 | 1.98 | 31 | Slightly sweated | Comparison |
| | 14 | Comparative compound (C) | $4\times10^{-2}$ | 0.11 | 1.95 | 30 | Slightly sweated | Comparison |
| | 15 | Comparative compound (C) | $6\times10^{-2}$ | 0.11 | 1.79 | 30 | Slightly sweated | Comparison |

TABLE 3-continued

| Sample No. | Experiment No. | Compound of Formula 1 | Chlorine-ion concentration in color developer (mol/l) | Whiteness of background (Dmin) | Color developability (Dmax) | Light fastness, Discoloration ratio, (%) | Sweating condition | Remarks |
|---|---|---|---|---|---|---|---|---|
| | 16 | Comparative compound (C) | $8 \times 10^{-2}$ | 0.10 | 1.80 | 30 | Slightly sweated | Comparison |
| 105 | 17 | I-5 | $1 \times 10^{-2}$ | 0.12 | 2.19 | 12 | Not sweated | Comparison |
| | 18 | I-5 | $4 \times 10^{-2}$ | 0.11 | 2.19 | 12 | Not sweated | Comparison |
| | 19 | I-5 | $6 \times 10^{-2}$ | 0.09 | 2.19 | 11 | Not sweated | Invention |
| | 20 | 1-5 | $8 \times 10^{-2}$ | 0.08 | 2.18 | 11 | Not sweated | Invention |
| 106 | 21 | I-16 | $1 \times 10^{-2}$ | 0.12 | 2.23 | 11 | Not sweated | Comparison |
| | 22 | I-16 | $4 \times 10^{-2}$ | 0.11 | 2.23 | 11 | Not sweated | Comparison |
| | 23 | I-16 | $6 \times 10^{-2}$ | 0.09 | 2.23 | 10 | Not sweated | Invention |
| | 24 | I-16 | $8 \times 10^{-2}$ | 0.08 | 2.22 | 10 | Not sweated | Invention |
| 107 | 25 | I-13 | $1 \times 10^{-2}$ | 0.12 | 2.10 | 14 | Not sweated | Comparison |
| | 26 | I-13 | $4 \times 10^{-2}$ | 0.12 | 2.11 | 14 | Not sweated | Comparison |
| | 27 | I-13 | $6 \times 10^{-2}$ | 0.10 | 2.12 | 13 | Not sweated | Invention |
| | 28 | I-13 | $8 \times 10^{-2}$ | 0.09 | 2.10 | 13 | Not sweated | Invention |
| 108 | 29 | I-8 | $1 \times 10^{-2}$ | 0.12 | 2.16 | 11 | Not sweated | Comparison |
| | 30 | I-8 | $4 \times 10^{-2}$ | 0.12 | 2.16 | 11 | Not sweated | Comparison |
| | 31 | I-8 | $6 \times 10^{-2}$ | 0.10 | 2.16 | 10 | Not sweated | Invention |
| | 32 | I-8 | $8 \times 10^{-2}$ | 0.09 | 2.14 | 10 | Not sweated | Invention |

As are obvious from Tables 3, it was proved that, in Samples 102 through 104 each applied with comparative compounds A, B or C, the light fastness was not effectively improved and the color developability and whiteness of background property were also unsatisfactory, and that, in Sample 102, the sweat resistivity was deteriorated, although the light fastness was something better. On the other hand, it was proved that, in the samples of the invention, sharp and clear images could be come out with the remarkably improved light fastness, excellent white background property and color developability, without any deterioration of sweat resistivity.

Even when a running processing is carried out with the passage of time in a rapid process, it was proved that not only the color developability, background whiteness and sweat resistivity are not deteriorated, but the light fastness improvement effects have been so excellent that nothing could be presumed from any conventional techniques.

Example 2

The tests were each tried by making use of the same samples as used in Example 1 and by changing the color developing time to be 20 seconds. The results from the samples of the invention were better than those obtained in Example 1.

Example 3

Sample 301, 302 and 303 were prepared in the same manner as in Sample 101, 102 and 109 in Example 1, respectively, except that the gelatin contained in each of layers are reduced by 0.941 times so that the total amount of gelatin to be 7.0 g/m$^2$. The samples were evaluated in the same procedure as in Example 1. Thus obtained test results are listed in the following Table 4. t,0710

The results of Experiments 335 and 336 are superior to those of Experiments 35 and 36 in Example 1.

Example 4

The color developers were each prepared in the same manner as in the preparation of the color developer used in Example 1, except that the color developing agent used in Example 1 was replaced by 2—2, a mixture of CD-5 and CD-9 and another mixture of 2—2 and CD-6, each equivalent in quantity, out of which 2—2 is an exemplified compound represented by Formula 2 of the invention and has a mol number equivalent to N-ethyl-N-(β-methanesulfonamidoethyl)-3-methyl-4-aminoaniline sulfate, that is exemplified compound CD-6. The evaluation was made in the same manner as in Example 1.

It was proved that each of the color developing agents 2—2, CD-5 and CD-9 can display not only a development activity superior to CD-6 used in Example 1, but also the effects of the invention. Among them, color developing agent 2—2 was proved to have excellent effects and the mixture thereof and CD-6 was also proved similarly to have the excellent effects.

Example 5

The tests were tried in the same manner as in Example 1, except that the processing steps carried out in Example 1 were changed as follows.

(Processing steps)

| Processing step | Temperature | Time | Amount replenished |
|---|---|---|---|
| Color developing | 38.0 ± 0.3° C. | 45 sec. | 80 ml/m$^2$ |
| Bleach-fixing | 35.0 ± 0.5° C. | 45 sec. | 120 ml/m$^2$ |
| Washing | 30 to 34° C. | 60 sec. | 150 ml/m$^2$ |
| Drying | 60 to 80° C. | 30 sec. | |

The compositions of the processing solutions will be given below.

(Color developing tank solution)

| | |
|---|---|
| Pure water | 800 ml |
| Triethylenediamine | 2 g |
| Diethylene glycol | 10 g |
| Potassium bromide | 0.01 g |
| Potassium chloride | 3.5 g |
| Potassium sulfite | 0.25 g |
| N-ethyl-N-(β-methanesulfonamidoethyl)- | 6.0 g |

-continued

| | |
|---|---|
| 3-methyl-4-aminoaniline sulfate | |
| N,N-diethylhydroxylamine | 6.8 g |
| Triethanolamine | 10.0 g |
| Sodium diethylenetriaminepentaacetate | 2.0 g |
| Fluorescent whitening agent, (a 4,4'-diaminostilbene sulfonic acid derivative) | 2.0 g |
| Potassium carbonate | 30 g |
| Add water to make in total of | 1 liter |
| Adjust pH to be | pH = 10.10 |
| (Color developer replenisher) | |

| | |
|---|---|
| Pure water | 800 ml |
| Triethylenediamine | 6 g |
| Diethylene glycol | 10 g |
| Potassium sulfite | 0.5 g |
| N-ethyl-N-(β-methanesulfonamidoethyl)-3-methyl-4-aminoaniline sulfate | 10.0 g |
| N,N-diethylhydroxylamine | 6.0 g |
| Triethanolamine | 10.0 g |
| Sodium diethylenetriaminepentaacetate | 2.0 g |
| Fluorescent whitening agent, (a 4,4'-diaminostilbene sulfonic acid derivative) | 2.5 g |
| Potassium carbonate | 30 g |
| Add water to make in total of | 1 liter |
| Adjust pH to be | pH = 10.60 |
| (Bleach-fixing tank solution and the replenisher therefor) | |

| | |
|---|---|
| Ferric ammonium diethylenetriamine-pentaacetate, dihydrate | 65 g |
| Diethylenetriaminepentaacetic acid | 6 g |
| Ammonium thiosulfate (in an aqueous 70% solution) | 100 ml |
| 5-amino-1,3,4-thiadiazole-2-thiol | 2.0 g |
| Ammonium sulfite (in an aqueous 40% solution) | 27.5 ml |
| Add water to make in total of | 1 liter |
| Adjust pH with potassium carbonate or glacial acetic acid to be | pH 6.5 |
| (Washing tank solution and the replenisher therefor) | |

| | |
|---|---|
| Orthophenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent whitening agent (Tinopal SFP) | 2.0 g |
| 1-hydroxyethylidene-1,1-diphosphonic acid | 1.8 g |
| $BiCl_3$ (in an aqueous 45% solution) | 0.65 g |
| $MgSO_4.7H_2O$ | 0.2 g |
| PVP (polyvinyl pyrrolidone) | 1.0 g |
| Aqueous ammonia (in an aqueous 25% ammonium hydroxide solution) | 2.5 g |
| Trisodium nitriloacetate | 1.5 g |
| Add water to make in total of | 1 liter |
| Adjust pH with sulfuric acid or aqueous ammonia to be | pH = 7.5 |

The samples of the invention were capable of providing the sharp and clear images displaying the excellent effects of the invention.

What is claimed is:

1. A method for forming a photographic color image comprising:

imagewise exposing a silver halide color photographic light-sensitive material comprising a support having provided thereon a photographic layer including a silver halide emulsion layer and a non-light-sensitive layer, to form an imagewise exposed light-sensitive material;

developing said imagewise exposed light-sensitive material with a color developer to form a developed light-sensitive material, and bleach-fixing said developed light-sensitive material with a bleach-fixing solution, wherein said silver halide emulsion layer or said non-light-sensitive layer contains a compound represented by at least one of Formula 1a and 1b, and said color developer contains chloride in an amount of not less than $6\times10^{-2}$ mol/l;

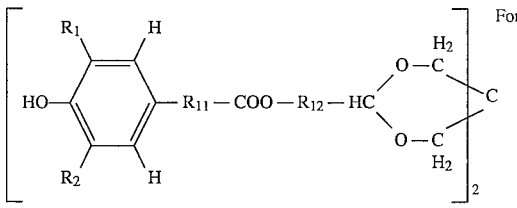

Formula 1a

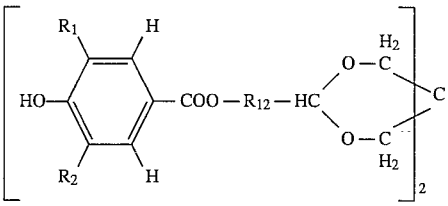

Formula 1b wherein $R_1$ is tertiary alkyl; $R_2$ is primary alkyl with the proviso that $R_2$ does not have a phenyl group; and $R_{11}$ and $R_{12}$ are each alkylene.

2. The method of claim 1, wherein said compound represented by Formulas 1a or 1b is one in which the group represented by $R_2$ is a methyl group and the group represented by $R_1$ is a tertiary butyl group.

3. The method of claim 1, wherein said color developer contains a color developing agent represented by the following formula 2;

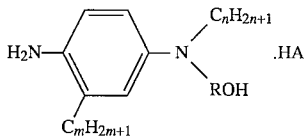

Formula 2 wherein R is a straight or a branched alkylene group; m and n are each an integer of 1 to 4; and HA is inorganic or organic acid.

4. The method of claim 1, wherein said compound represented by Formula 1 is contained in said silver halide emulsion layer or said non-light-sensitive layer in an amount of from 0.01 g/m$^2$ to 0.30 g/m$^2$.

5. The method of claim 1, wherein said photographic layer includes a blue-sensitive silver halide emulsion layer, a green-sensitive silver halide emulson layer, a red-sensitive silver halide emulsion layer and a non-light-sensitive layer.

6. The method of claim 5, wherein said compound represented by Formula 1 is contained in said blue-sensitive silver halide emulsion layer.

7. The method of claim 1, wherein the total amount of gelatin contained in said photographic layer is not more than 7.4 gram per square meter.

8. The method of claim 1, wherein said developing step is carried out for a time not more than 30 seconds.

* * * * *